US006648099B2

(12) United States Patent
Dooley

(10) Patent No.: US 6,648,099 B2
(45) **Date of Patent: *Nov. 18, 2003**

(54) EXHAUST PIPE AND MUFFLER FOR MOTORCYCLE THAT DOES NOT HEAT DISCOLOR

(76) Inventor: Mark W. Dooley, 6374 E. Paseo Celeste, Anaheim Hills, CA (US) 92807

( * ) Notice: Subject to any disclaimer, the term of this patent is extended or adjusted under 35 U.S.C. 154(b) by 0 days.

This patent is subject to a terminal disclaimer.

(21) Appl. No.: 10/179,485

(22) Filed: Jun. 20, 2002

(65) Prior Publication Data

US 2002/0166719 A1 Nov. 14, 2002

Related U.S. Application Data

(63) Continuation of application No. 09/516,843, filed on Mar. 2, 2000, now Pat. No. 6,408,980.

(51) Int. Cl.[7] ..... F01N 7/08; B60K 13/04

(52) U.S. Cl. ..... 181/228; 180/309

(58) Field of Search ..... 181/227, 228, 181/249, 255, 282, 246, 262, 244, 245; 180/89.2, 309

(56) References Cited

U.S. PATENT DOCUMENTS

| | | | |
|---|---|---|---|
| 3,104,733 | A | 9/1963 | Ludlow |
| 3,677,365 | A | 7/1972 | Wright et al. |
| 3,858,678 | A | 1/1975 | Haren |
| 4,356,885 | A | 11/1982 | Dello |
| 4,487,289 | A | 12/1984 | Kicinski et al. |
| 5,036,947 | A | 8/1991 | Metzger |
| 5,388,408 | A | 2/1995 | Lawrence |
| 5,464,952 | A | 11/1995 | Shah et al. |
| 5,508,478 | A | 4/1996 | Barry |
| 5,799,395 | A | 9/1998 | Nording et al. |
| 5,907,134 | A | 5/1999 | Nording et al. |
| 5,966,933 | A | 10/1999 | Ishihara et al. |

FOREIGN PATENT DOCUMENTS

| | | |
|---|---|---|
| DE | 199 12 466 A1 | 10/1999 |
| EP | 0 448 728 A1 | 10/1991 |

OTHER PUBLICATIONS

Patent Abstracts of Japan, vol. 012, No. 134 (M–689), Apr. 23, 1988—& JP 62 255514 A (Yamaha Motor Co., Ltd.), Nov. 7, 1987 abstract; figures 1–8.

Patent Abstracts of Japan, vol. 1998, No. 05, Apr. 30, 1998—&JP 10–002220 A (Suzuki Motor Corp.), Jan. 6, 1998 abstract; figures 1–3.

Patent Abstracts of Japan, vol. 008, No. 158 (M–311), Jul. 21, 1984—& JP 59 054722 A (Honda Giken Kogyo KK), Mar. 29, 1984 abstract; figures 1–5.

White Brothers American Street Catalog #20, 1998.

*Primary Examiner*—Khanh Dang

(57) ABSTRACT

A chromed exhaust pipe and muffler for motorcycles that is capable of withstanding the extreme heat generated at high rpm's of a motorcycle engine without discoloring or "bluing". A double wall construction is utilized for the exhaust pipe and muffler with the back side of the exterior chromed pipe cut away along the length of the pipe from the mounting flange to the muffler core. The cut-away exterior pipe is dimensional to allow the interior pipe to be inserted—one piece from the mounting flange to the muffler core, as well as cooling the exterior pipe, thereby preventing heat discoloration of the exterior chromed pipe. The muffler core is completely enclosed by an interior pipe section, allowing gases to flow out the back end only. The interior pipe is spaced apart from and enclosed in an exterior chromed pipe. The double walled muffler section prevents discoloration and reduces heat transfer to the exterior chromed pipe.

14 Claims, 2 Drawing Sheets

EXHAUST PIPE AND MUFFLER FOR MOTORCYCLE THAT DOES NOT HEAT DISCOLOR

CROSS-REFERENCE TO RELATED APPLICATIONS

This application is a continuation of application Ser. No. 09/516,843 filed on Mar. 2, 2000, now U.S. Pat. No. 6,408,980, for an Exhaust Pipe And Muffler For Motorcycle That Does Not Heat Discolor.

BACKGROUND OF THE INVENTION

1. Field of the Invention

The present invention relates generally to improvements in hot exhaust gas pipes and mufflers and more particularly pertains to new and improved decorative exhaust gas pipes and mufflers used on motorcycles and customized automobiles.

2. Description of Related Art

One of the most critical problems confronting the developers of motorcycle exhaust pipes and mufflers or exhaust pipes and mufflers for automobiles which are exposed for appearance purposes has been the prevention of heat discolorization of the chromed exhaust pipes and muffler casings from the extreme heat generated by high engine performance.

Although the prior art has been concerned with preventing heat transfer to the outer housing of a motorcycle exhaust system, none have really accomplished that goal, none have prevented heat discoloration as the present invention. U.S. Pat. No. 4,356,885 for a Chambered-Core Motorcycle-Exhaust Apparatus was granted on Nov. 2, 1982 to Christy J. Dello. The exhaust system described in the Dello patent is concerned with a double wall exhaust system wherein the inner core is mounted within a tubular housing having a larger diameter than the inner core so as to establish an annular chamber between the outer housing and the inner exhaust core. Dello specifically requires the use of an inner exhaust core system that has a plurality of interconnected pipe segments.

U.S. Pat. No. 3,858,678 was granted Jan. 7, 1975 for a Muffler With Rotary Gas Flow to Ralph Haren. It is directed to a muffler construction that has an outer shell which is clamped to the ends of a flow tube which contains flow obstruction devices to prevent or restrict straight through gas flow.

U.S. Pat. No. 3,104,733 was granted Sep. 24, 1963 for a Sound Attenuating Gas Pipe to Edmund Ludlow. It is directed to an exhaust system which has an outer pipe with a plurality of sections or inserts mounted within the outer pipe that are coaxially aligned within the outer pipe to define a main gas flow passage therethrough. The combination is designed so that each adjacent pair of inserts act in combination with the adjacent wall of the outer pipe to define a "resonating chamber of volume".

U.S. Pat. No. 5,799,395 was granted Sep. 1, 1998 and U.S. Pat. No. 5,907,134 was granted May 25, 1999 for Air Gap-Insulated Exhaust Pipe And Process For Manufacturing An Air Gap-Insulated Exhaust Pipe to Thomas Nording, et al. Both patents are directed to a double wall exhaust pipe wherein the inner pipe which is comprised of sections connected by a sliding fit which are prevented from contacting the walls of the outer pipe as the result of the thermal expansion of both pipes during operation. None of these prior art patents prevent the heat discoloration as does the present invention.

SUMMARY OF THE INVENTION

A decorative chromed exhaust pipe for internal combustion engines is provided which does not discolor from the heat generated by the exhaust gases flowing from the engine to the muffler. A double-walled muffler is completely encased by an interior pipe section which only allows gases to flow out the back end from the inlet end. The exhaust pipe, from the mounting flange to the muffler has a double wall construction with the exterior wall chromed. The exterior chromed pipe is cut-away on its back side, from the mounting flange to the muffler, allowing the interior one piece pipe to be inserted through the cut-away section. Mounting flanges are welded to the exterior and interior pipes at the back side for mounting the exhaust pipe to the vehicle and hold the interior pipe in a spaced apart relation to the exterior pipe. During operation, the cutaway back side of the exterior pipe provides cooling to the exterior pipe sufficient to prevent heat discoloration of the exterior pipe under the heaviest load conditions.

BRIEF DESCRIPTION OF THE DRAWINGS

The exact nature of this invention as well as its objects and many of the attendant advantages will be readily appreciated as the invention becomes better understood upon consideration of the following detailed description in relation to the accompanying drawings in which like reference numerals designate like parts throughout the figures thereof and wherein.

DETAILED DESCRIPTION OF THE PREFERRED EMBODIMENTS

Figures 1, 2, 3, 4, 5:
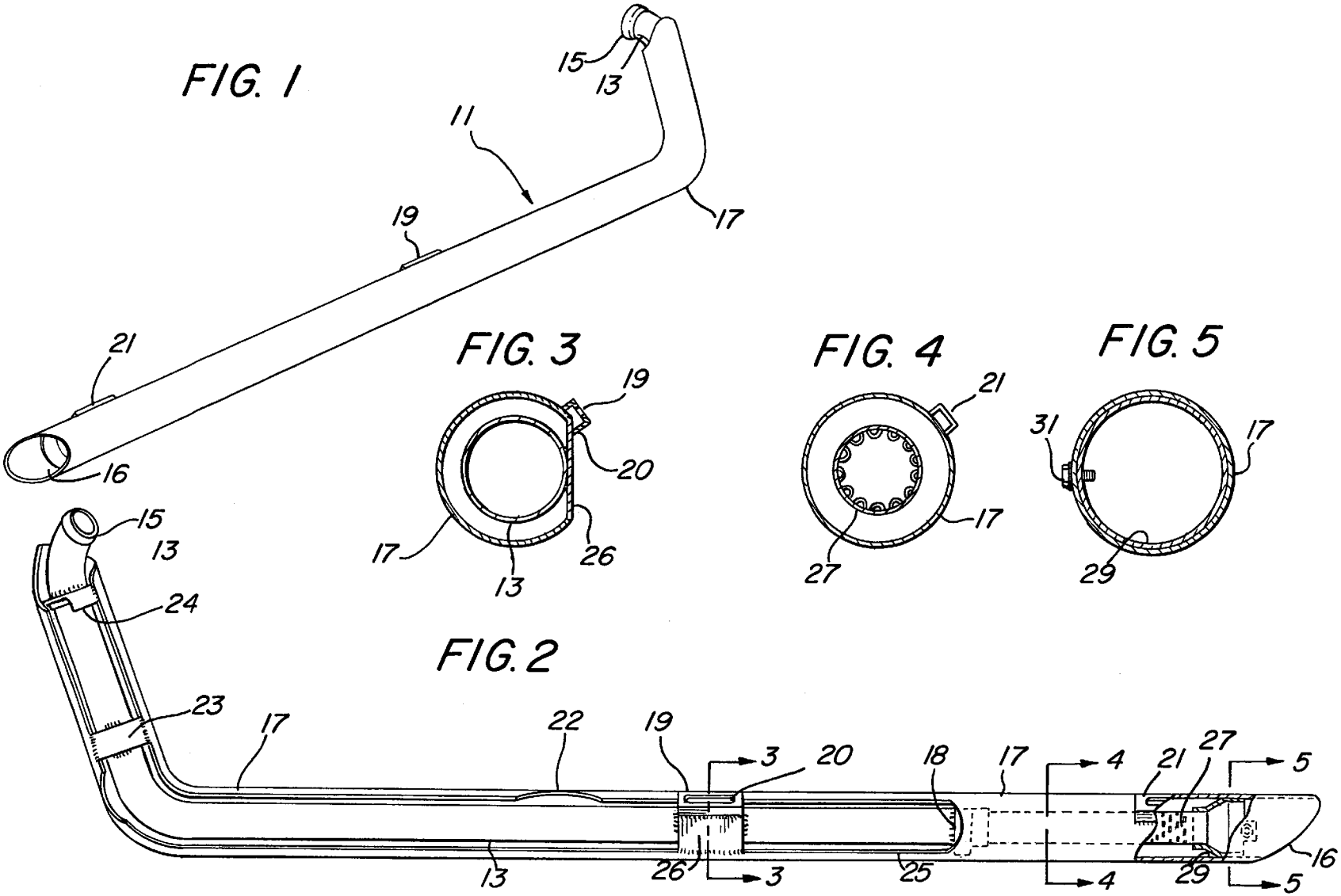
FIG. 1 is a perspective of a preferred embodiment of the present invention.
FIG. 2 is a plan view, partly in section, of the preferred embodiment of FIG. 1.
FIG. 3 is a sectional view of the device of FIG. 2 taken along line 3—3 of FIG. 2.
FIG. 4 is a section of the device of FIG. 2 taken along line 4—4 of FIG. 2.
FIG. 5 is a section of a device of FIG. 2 taken along line 5—5 of FIG. 2.

FIG. 1 shows the exhaust pipe, muffler combination 11 of the present invention in one of the many possible forms that it may take. Although FIG. 1 illustrates that the pipe and muffler combination 11 only has one bend along its length, it could be straight, or have multiple bends, as required to follow the lines of the particular motorcycle or automobile that it is designed to fit.

The exhaust pipe and muffler 11 is essentially made up of two pipes, one within the other. An internal pipe 13 has a mounting flange at a first or inlet end 15 for mounting to the header of a motorcycle or automobile. An external pipe 17 which is larger in diameter than the internal pipe 13, surrounds the outwardly facing side (front side) of the internal pipe 13 so that the appearance to a viewer is of only one pipe. The diameter of external pipe 17 has an exhaust or outlet end 16. A pair of mounting brackets 19 and 21 are welded to the backside of the exhaust pipe 17 for mounting the pipe assembly to the vehicle.

FIG. 2 illustrates the back side of the dual wall exhaust pipe 11 of the present invention. The back side is the side that faces the vehicle and is not observable by a casual viewer when the exhaust pipe and muffler combination is mounted to the vehicle. As can be seen in FIG. 2, the internal pipe 13 which carries the exhaust gases is a single pipe extending all the way from its first input flange end 15 to its output or second end 18 which slips into a muffler core 27. The external pipe 17 surrounds the internal pipe 13 completely on the front side and is cut away at the back side along its length from the mounting flange 15 of internal pipe 13 all the way to the input end 18 of the muffler core 27.

This cut away or aperture 25 has a width which exceeds the diameter of the internal pipe 13. Dimensioning the aperture 25 in width and length in this manner accomplishes two things. First and foremost, it provides an exceptional amount of cooling to the external pipe 17. Even during peak extended performance, external pipe 17 will not become discolored from heating by the hot exhaust gases passing through internal pipe 13. This discolorization is also known as "bluing". Secondly, the length and breadth of aperture 25 allows the invention to be manufactured simply and swiftly, by permitting the internal pipe 13, regardless of the bends in the pipe, to be inserted into the external pipe 17 in one piece through the aperture 25.

A muffler core 27 which includes a slip joint 18 at its input end and a baffle spacer 29 at its output end is held in place by a nut 31 passing through the external pipe 17 into the baffle 29 of muffler 27. After internal pipe 13 has been slipped into external pipe 17, with its output end inserted into slip joint 18 of the muffler core 27, various spacer support members are welded in place to maintain an even distribution of spacing between the internal exhaust pipe 13 and the external pipe 17. At the input end, at mounting flange 15, a support spacer 24 is welded to internal pipe 13 and external pipe 17. Before the first bend in the pipes, a second support 23 is welded to internal pipe 13 and external pipe 17. Another support member 26 is mounted further on down the length of the exhaust pipe. This support member also contains a mounting bracket 20 having mounting slot 19 to facilitate the mounting of the exhaust pipe to the motorcycle or vehicle by a nut and bolt arrangement. Another mounting bracket 21 is located at the output end 16 of the exhaust pipe.

As can be seen in FIGS. 3, 4, and 5, which are cross-sections of different portions of FIG. 2, looking in the direction of the arrows 3—3, 4—4, and 5—5, once assembled the exhaust pipe and muffler combination 11 of the invention appears and functions as a single unit. The muffler core 27 has a solid external surface with a baffle structure or packing inside thereby allowing gases to only flow out the back end of the core. A preferred structure for the muffler core 27 is illustrated in FIG. 7 and described below.

Figures 6, 7, 8:
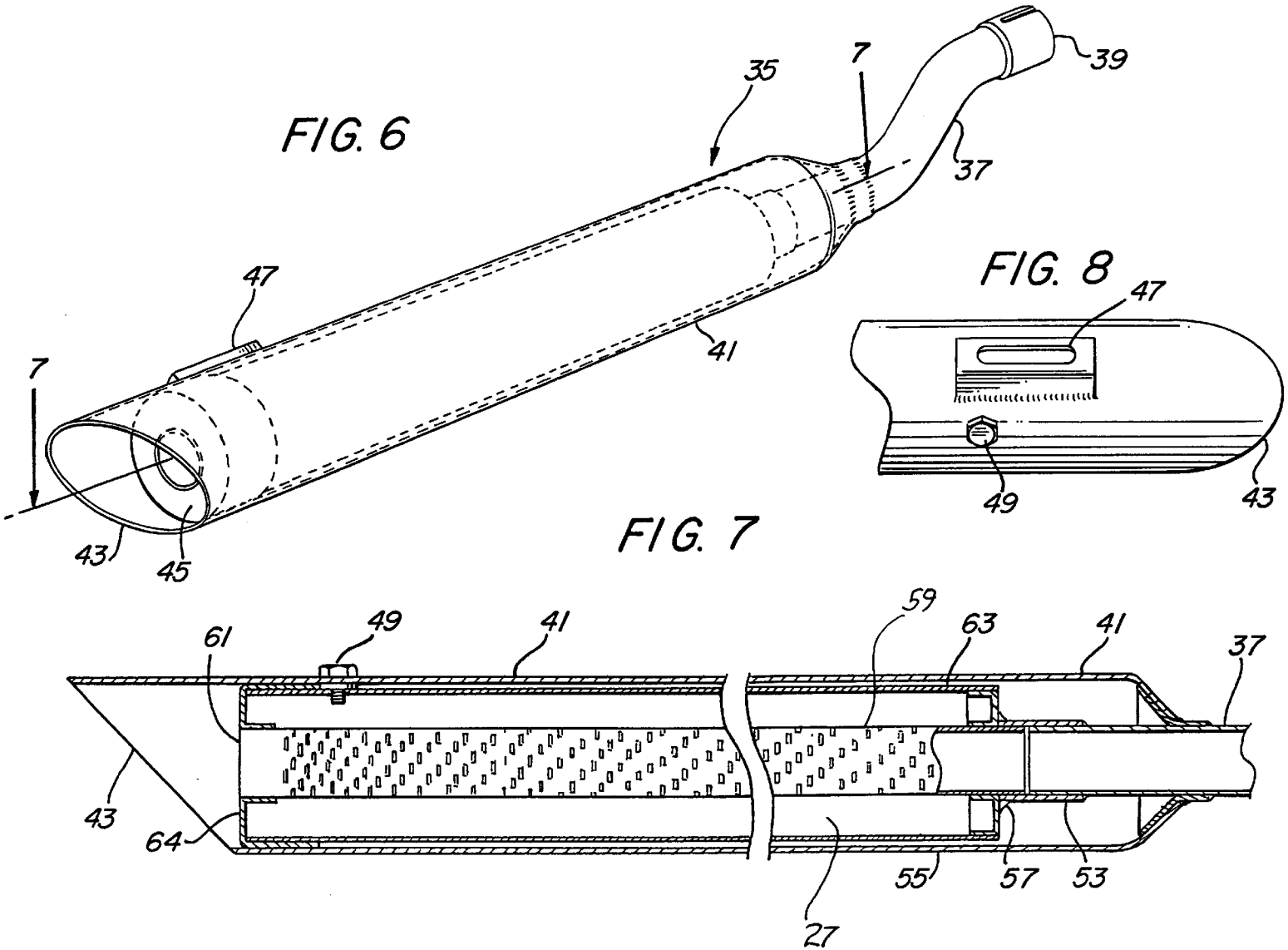
FIG. 6 is a perspective of the muffler according to the present invention.
FIG. 7 is a section of the device of FIG. 6 taken along line 7—7 of FIG. 6.
FIG. 8 is a plan view showing a portion of the output end of the muffler of FIG. 6.

Refer now to FIG. 6 which shows a preferred embodiment of the double wall muffler 35 of the present invention. Pipe 37 has a slip joint 39 for mounting to an exhaust pipe or port of the vehicle. An input end of pipe 37 is inserted into one end of external casing 41 and welded circumferentially around the other end so as to maintain pipe 37 evenly spaced within external casing 41. The output end 43 of external casing 41 is also the output end 45 of a muffler core which is more clearly illustrated in FIG. 7.

The muffler core 27 is completely contained within external casing 41. The muffler core 27 has a casing 63 which contains within it a baffle core 59 that is welded into casing 63 at the input ends by a circumferential weld 57. A slip joint 53 on the interior muffler casing 63 receives input pipe 37. The output end 61 of the baffle core 59 contained within casing 63 is supported and baffled by a donut-shaped end unit 64 so that exhaust gases entering the interior casing 63 of muffler 35 by way of pipe 37 are only permitted to exit at output opening 61 of muffler core 59.

The baffle core 59 is completely enclosed except for its input end and output end 61 by the internal casing 63. Internal casing 63 is in turn is completely contained within the external casing 41. Internal casing 63 with its baffle core 59 permanently contained therein may be removed from external casing 41 for replacement purposes by loosening nut 49 which fastens the output end of internal casing 63 to the external casing 41.

The muffler includes a mounting bracket 47 (FIG. 8) for mounting it to the motorcycle or automobile.

This particular construction of a double wall muffler provides two highly desirable results. The exterior casing 41 is much cooler to the touch and the overall operation of the muffler is much quieter than prior art double wall mufflers.

What is claimed is:

1. A decorative exhaust pipe for conveying hot exhaust gases, comprising:

a continuous one-piece interior exhaust pipe having a first end and a second end;

a mounting flange fastened to the first end of the interior exhaust pipe for mounting to an exhaust generating source;

a core for baffling the noise of the exhaust gases having a first end fastened to the second end of the interior exhaust pipe for receiving hot gases, and a second end serving as an outlet for discharging hot gases:

a core enclosure completely surrounding the baffle core from the inlet to the outlet; and a continuous exterior pipe having a first end and a second end sized to contain the interior exhaust pipe and the core attached thereto in a spaced apart relation, the back side of the exterior pipe having an aperture running along a portion of its length.

2. The decorative exhaust pipe of claim 1 wherein the aperture in the exterior pipe extends from the mounting flange to the core.

3. The decorative exhaust pipe of claim 1 wherein the aperture running along the back side of the exterior pipe is sized to permit the diameter of the interior exhaust pipe to fit therethrough.

4. The decorative exhaust pipe of claim 3 further comprising a spacer attached to the interior exhaust pipe and the exterior exhaust pipe at the mounting flange end to keep the interior exhaust pipe spaced at a fixed distance from the exterior pipe.

5. The decorative exhaust pipe of claim 3 further comprising a mounting bracket attached to the interior exhaust pipe and the exterior pipe at its back side for keeping the interior exhaust pipe spaced at a fixed distance from the exterior pipe and mounting the decorative exhaust pipe to an object.

6. The decorative exhaust pipe of claim 3 further comprising a spacer attached to the second end of the interior exhaust pipe to keep the muffler core spaced at a fixed distance from the exterior pipe.

7. The decorative exhaust pipe of claim 3 further comprising a spacer baffle attached to the output end of the muffler core to keep the muffler core spaced at a fixed distance from the exterior pipe and cause all exhaust gas to flow only out of the output end of the muffler core.

8. A decorative exhaust pipe for motorcycles, comprising:

a continuous one-piece interior exhaust pipe having a first end and a second end and at least one bend along its length, the first end adapted for fastening to a motorcycle engine;

a core for baffling the noise of the exhaust gases having a first end fastened to the second end of the interior exhaust pipe for receiving hot gases, and a second end serving as an outlet for discharging hot gases;

a core enclosure completely surrounding the baffle core from the inlet to the outlet and being fixedly fastened to the first and second ends of the baffle core; and a continuous exterior pipe having a first end and a second end sized to contain the interior exhaust pipe and the muffler core attached thereto in a spaced apart relation.

9. The motorcycle exhaust pipe of claim 8 wherein the exterior pipe has an aperture running along a part of its length on the side of the exterior pipe facing the motorcycle.

10. The motorcycle exhaust pipe of claim 9 wherein the aperture extends from the first end of the exterior pipe to the core.

11. The motorcycle exhaust pipe of claim 10 wherein the aperture in the exterior pipe is sized to pass the diameter of the interior exhaust pipe therethrough.

12. The motorcycle exhaust pipe of claim 11 further comprising a mounting bracket attached to the interior exhaust pipe and the exterior exhaust pipe at the aperture in the exterior exhaust pipe for keeping the interior exhaust pipe spaced at a fixed distance from the exterior pipe and mounting the decorative exhaust pipe to the motorcycle.

13. The motorcycle exhaust pipe of claim 8 wherein the core comprises a tube having a plurality of apertures along its length and around its circumference for gases to travel therethrough.

14. The motorcycle exhaust pipe of claim 13 wherein the core enclosure has a sleeve at the first end of the core for sealably attaching to the second end of the interior exhaust pipe;

whereby the core and core enclosure may be removed from the exterior enclosure as a unit.

* * * * *